US011974643B2

(12) United States Patent
Gee et al.

(10) Patent No.: US 11,974,643 B2
(45) Date of Patent: May 7, 2024

(54) CUSTOMIZABLE, MODULAR ORGANIZING STORAGE SYSTEM

(71) Applicant: Godai Group LLC, Santa Ana, CA (US)

(72) Inventors: Garrett Gee, Santa Ana, CA (US); Rusty Huber, Orange, CA (US)

(73) Assignee: Godai Group LLC, Santa Ana, CA (US)

( * ) Notice: Subject to any disclaimer, the term of this patent is extended or adjusted under 35 U.S.C. 154(b) by 223 days.

(21) Appl. No.: 17/653,301

(22) Filed: Mar. 3, 2022

(65) Prior Publication Data

US 2023/0024899 A1 Jan. 26, 2023

Related U.S. Application Data

(60) Provisional application No. 63/203,470, filed on Jul. 23, 2021.

(51) Int. Cl.
*A45C 13/02* (2006.01)
*B65D 25/10* (2006.01)

(52) U.S. Cl.
CPC ..... *A45C 13/02* (2013.01); *B65D 25/102* (2013.01); *A45C 2013/026* (2013.01)

(58) Field of Classification Search
CPC . A45C 13/02; A45C 2013/026; A45C 7/0045; A45C 13/30; B65D 25/102
USPC ..... 220/528
See application file for complete search history.

(56) References Cited

U.S. PATENT DOCUMENTS 3,211,283 A * 10/1965 Hassler ..... B65D 25/102 206/424
4,984,760 A * 1/1991 Cohn ..... F16M 13/022 248/206.3
5,027,960 A * 7/1991 Rainville ..... B63B 32/83 211/85.7
5,082,111 A * 1/1992 Corbitt, Jr. ..... A61M 25/02 206/478
5,242,063 A * 9/1993 Ericksen ..... A47K 3/281 248/205.2
5,366,070 A * 11/1994 Wolov ..... A45C 13/02 206/214
5,529,184 A * 6/1996 Sadow ..... B65D 81/02 206/583
6,036,019 A * 3/2000 Silverman ..... B65D 81/3834 206/478

(Continued)

*Primary Examiner* — Ernesto A Grano
(74) *Attorney, Agent, or Firm* — Dunlap Bennett & Ludwig, PLLC; Anna L. Kinney

(57) ABSTRACT

A modular organizational carrier device includes at least one strap module; at least one rigid divider loop; and a carrier having a touch fastener attached to its surface. The strap module has a rigid base with four sidewalls, two opposite surfaces, one of which has a mating touch fastener attached. An elastic strap extends across the other surface from sidewall to sidewall. The divider has four sidewalls forming a rounded rectangle surrounding an aperture through which the strap module slides. One of the sidewalls is concave, extending into the aperture so the aperture tapers at its center. A method of organizing articles on the carrier includes sliding the divider loop along the strap module, subdividing the elastic strap length; pressing the rigid base onto to the carrier surface; and sliding the article snugly between a first portion of the elastic strap and the rigid base.

9 Claims, 4 Drawing Sheets

(56) References Cited

U.S. PATENT DOCUMENTS 6,244,400 B1 * 6/2001 Bowers ..... A45C 3/02 190/110
6,397,438 B1 * 6/2002 DeWan ..... A47K 5/05 24/17 AP
6,782,654 B1 * 8/2004 Borchardt ..... A01K 97/06 248/205.2
7,219,795 B2 * 5/2007 Poux ..... B65D 85/30 206/592
7,588,216 B1 * 9/2009 Hoyl ..... H02G 3/30 248/205.2
8,167,131 B1 * 5/2012 Anderson ..... A45F 3/02 190/102
8,864,004 B2 * 10/2014 Crawford ..... A45C 11/24 224/684
9,655,420 B2 * 5/2017 Mathews, Jr. ..... A45C 13/02
10,258,154 B2 * 4/2019 Matuszewski ..... A47B 96/14
10,405,639 B2 * 9/2019 Smith ..... A45D 44/00
2005/0249567 A1 * 11/2005 Cucknell ..... B60R 11/00 410/56
2008/0277301 A1 * 11/2008 Gill ..... B65D 25/102 206/446
2013/0277262 A1 * 10/2013 Nemard ..... A61B 50/31 206/438
2015/0033680 A1 * 2/2015 Koch ..... B65B 11/58 220/660
2016/0302579 A1 * 10/2016 Chang ..... B60N 2/787
2017/0160053 A1 * 6/2017 Chavira ..... A45C 13/02
2018/0249802 A1 * 9/2018 Aizenberg ..... A45C 7/0095
2018/0263344 A1 * 9/2018 Seminara ..... A45C 11/00
2019/0092556 A1 * 3/2019 Chou ..... B65D 5/5213
2019/0281938 A1 9/2019 Eaton
2021/0267356 A1 9/2021 Chiu et al.
2021/0309440 A1 * 10/2021 Zheng ..... B65D 33/2566
2022/0002061 A1 * 1/2022 Cotte ..... B65D 25/102
2022/0266073 A1 * 8/2022 Dalziel ..... A62B 35/0037
2022/0338457 A1 * 10/2022 Zhang ..... A01K 97/08

* cited by examiner

CUSTOMIZABLE, MODULAR ORGANIZING STORAGE SYSTEM

CROSS-REFERENCE TO RELATED APPLICATION

This application claims the benefit of priority of U.S. provisional application No. 63/203,470, filed Jul. 23, 2021, the contents of which are herein incorporated by reference.

BACKGROUND OF THE INVENTION

The present invention relates to organizing systems and, more particularly, to a customizable, modular organizing storage system.

Every consumer has their own unique needs with respect to organizing and storing items securely for transport and everyday use. It is difficult to identify a single bag or case with just the right size and number of compartments to accommodate the various tools and devices a consumer may want to keep in the same kit from a wide array of manufacturers.

On-the-go storage and carry solutions are typically designed to the specifications of a single interest/hobby, such as camera bags and tackle boxes, preventing the user from mixing unrelated/unintended items. Generic storage solutions such as backpacks, sling bags, and belt pouches lack the customization and adjustability required to separate and securely hold several individual items, especially for irregular combinations of shapes and sizes.

Procuring a dedicated and secure organizational solution for every item in one's kit is prohibitively inefficient from a cost and convenience perspective. A generic storage solution, though less expensive and more convenient, can compromise organizational optimization and protection of the items from damage.

As can be seen, there is a need for a versatile storage and carry means.

SUMMARY OF THE INVENTION

In one aspect of the present invention, an modular organizational system comprises at least one strap module having: a rigid base with a first surface having four sidewalls and a second surface opposite the first surface, the second surface having a first touch fastener attached thereto; and an elastic strap extending across the first surface from a first sidewall of the four sidewalls to a second sidewall opposite the first sidewall, said elastic strap being reversibly matable with a second touch fastener; and at least one rigid divider loop having four sidewalls forming an aperture configured to slidably accommodate the at least one strap module.

In another aspect of the present invention, a modular organizational carrier device is provided, comprising: at least one strap module having: a rigid base with a first surface having four sidewalls and a second surface opposite the first surface, the second surface having a first touch fastener attached thereto; and an elastic strap extending across the first surface from a first sidewall of the four sidewalls to a second sidewall opposite the first sidewall; at least one rigid divider loop having four sidewalls forming a rounded rectangle surrounding an aperture configured to slidably accommodate the at least one strap module, with one of the four sidewalls having a concave configuration, extending into the aperture such that the aperture tapers at its center; and a carrier device having a second touch fastener attached to at least one carrier surface, said second touch fastener being matable with the first touch fastener.

In another aspect of the present invention, a method of organizing articles on a carrier is provided, comprising: providing the modular organizational system; sliding the at least one rigid divider loop along the at least one strap module, thereby subdividing the elastic strap length to form a first portion of the elastic strap that snugly accommodates an article; pressing the second surface of the rigid base onto to the at least one carrier surface such that the first touch fastener mates with the second touch fastener; and sliding the article between the first portion of the elastic strap and the rigid base.

These and other features, aspects and advantages of the present invention will become better understood with reference to the following drawings, description, and claims.

DETAILED DESCRIPTION OF THE INVENTION

Figure 1:
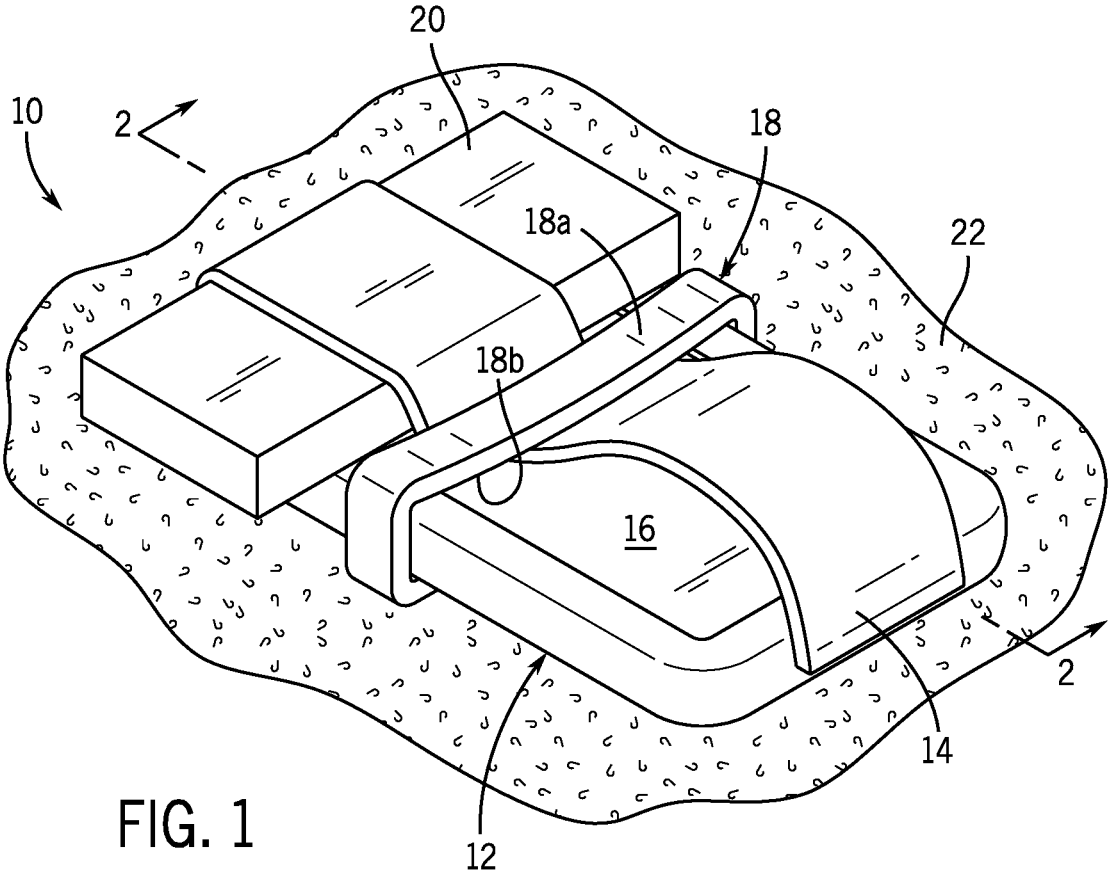
FIG. 1 is a top perspective view of a modular strap system according to an embodiment of the present invention.
Figure 2:
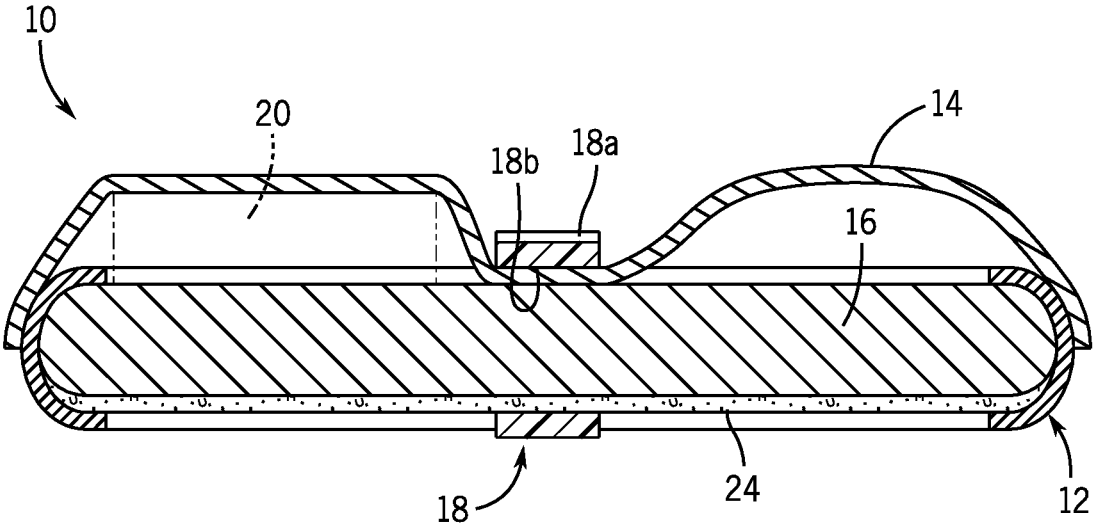
FIG. 2 is a sectional view thereof, taken along line 2-2 of FIG. 1.
Figure 3:
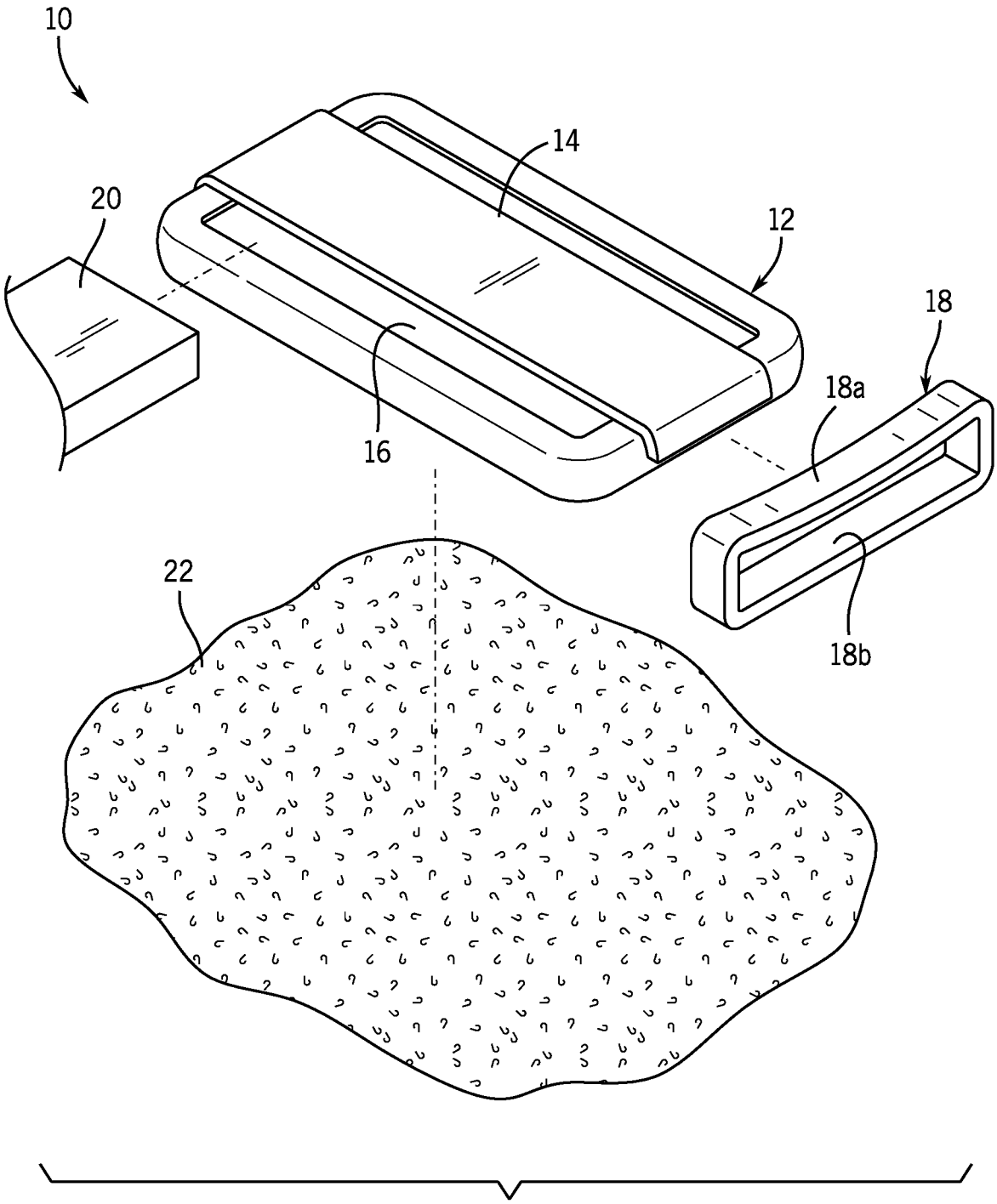
FIG. 3 is an exploded top perspective view thereof.
Figure 4:
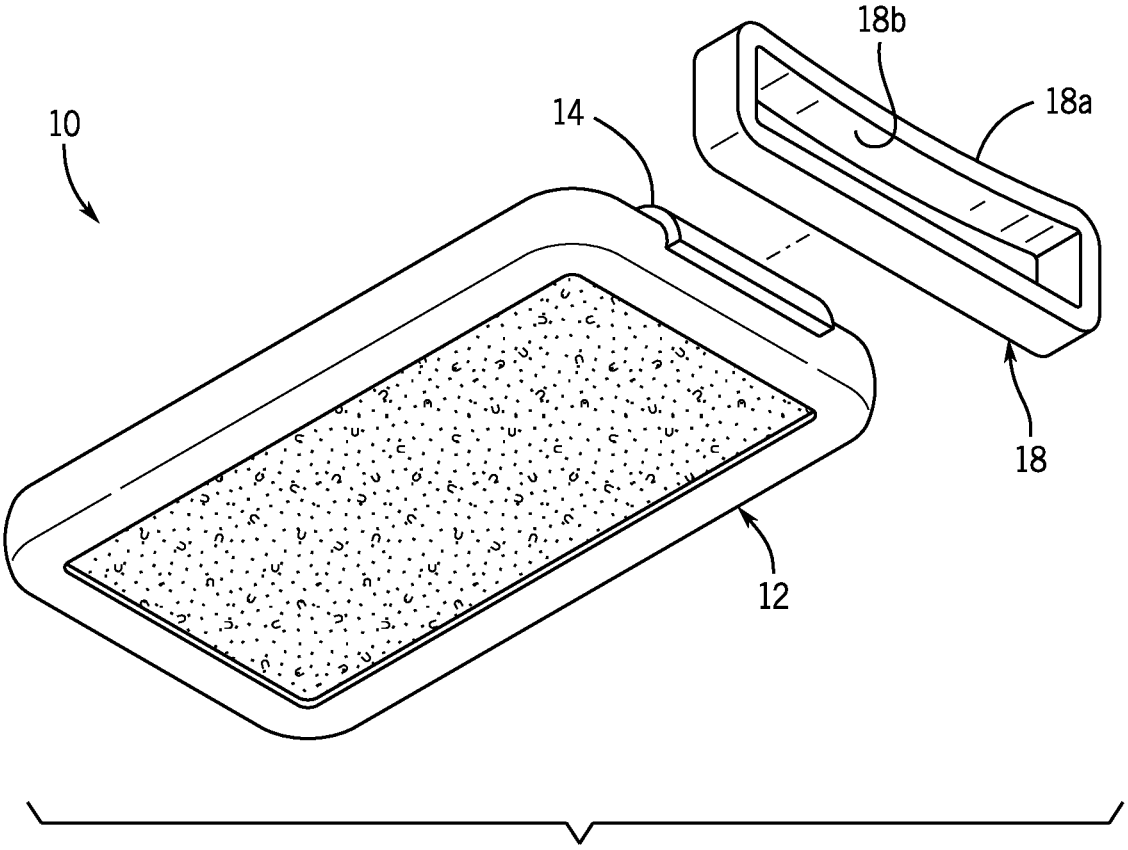
FIG. 4 is an exploded bottom perspective view of a strap module and a divider loop thereof.
Figure 5:
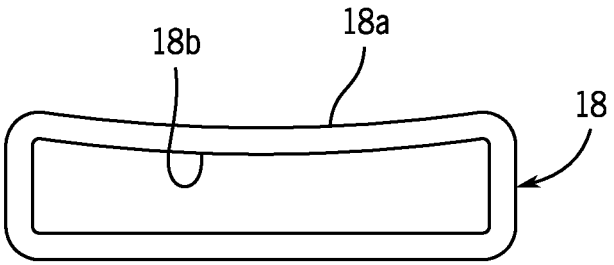
FIG. 5 is a front elevation view of the divider loop thereof.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

As used herein, the term "touch fastener" refers to a hook-and-loop fastener and the like, as well as to the hook portion of the fastener and to the loop portion of the fastener. The hook portion of the fastener and the loop portion of the fastener are reversibly matable.

Broadly, one embodiment of the present invention is a modular organizational system comprising multiple strap modules that may be affixed within or on a carrier and arranged in any selected position and orientation. The organizational system further comprises one or more rigid divider loops that are slidable into any position along the length of the straps, subdividing the strap module into multiple segments having widths suitable to hold a given set of items. The multiplicity of segments created with the divider loops is limited by the total length of the strap module and the width of the items and divider loops in use.

The inventive strap modules feature a hook and/or loop-compatible elastic band with a rigid backing or rigid base that when combined with divider loop strap segmentation, provides unlimited arrangement variations including number, length, and tension. This system does not rely on any fixed-position anchor points and strap modules may be arranged on the carrier surface in any position or orientation.

The design and its construction are affordable, durable, and versatile while remaining intuitive and easy to use.

The present invention provides an organizational system comprising multiple modular strap components that may be affixed within or onto a carrier and arranged in any selected position and orientation. The strap modules may be fastened securely anywhere thereon, instead of at designated locations built into the carrier. The lack of discrete connection points between the carrier and the strap modules enables a nearly infinite combination of positions and orientations to accommodate items of substantially all shapes and sizes within or on the same carrier, regardless of categorization or industry. Item-specific modules are unnecessary. Through the precise adjustment of elastic band segments and the placement of strap modules within the carrier, any combination of items may be accommodated, organizing articles with ease and efficiency. The user may dial-in the exact amount of elastic required to hold items down. Due to the strap module hook and loop-fastenable backing and elastic upper, modules may be stacked to maximize space and/or to store like items together more effectively.

The carrier may take any suitable form with a loop-side or hook-side fabric substrate to accommodate mounting strap modules, including a pre-existing support for other hook and loop-compatible items. For example, the carrier may be a container or case of substantially any shape, size, and capacity or the carrier may be a flexible platform that may be fastened in a rolled position. The carrier comprises hook and/or loop fabric lining within or on the carrier.

The system generally includes several strap modules in various lengths and several divider loops for each strap module, with or without a carrier. A modular organizational carrier device may include strap modules, divider loops, and a carrier.

The strap module comprises three sub-components: an elastic band, a stabilizer base, and a hook-side or loop-side fabric backing. The stabilizer base prevents the elastic band from pulling up the edges of the fabric backing. The strap module width and divider loop width may be optimized to accommodate objects of various sizes. The strap module is adjustable via one or more rigid divider loops to provide a secure fit for each item as well as additional strap segments for more items. However, the strap modules function as elastic straps with or without the use of the divider loop. The elastic band comprises a hook and loop-compatible elastic material such that strap modules may be stacked, with the fabric backing of one module mating to the elastic band of another module, to save space and/or like items may be grouped together in more compact arrangements.

The divider loops are generally a rounded rectangle with rounded edges, having four sidewalls surrounding an interior aperture with a width consistent with the width of the strap modules. One of the longitudinal walls of the divider loop may have a concave curve such that the strap module is snugly accommodated inside the loop while still able to fully pass through the inner aperture even as it tapers at its center. The concave configuration or inward curve of the divider loop provides better leverage for holding down the elastic band, making the individual segments of the elastic taut enough to securely hold items in place.

The organizational system components may be manufactured as follows. The strap module may be formed by cutting predetermined sections of elastic band and hook-side fabric backing, adhering the elastic band across one surface of a stabilizer base, and adhering the hook-side fabric backing on an opposite surface of the stabilizer base, for example by sewing. The stabilizer may comprise a rigid plastic, made by molding or cutting the material to the same shape and size as the strap module. The divider loops may be fabricated from a high-density, high-durability material to produce a rectangular loop with rounded edges. Loop-side fabric substrate may be adhered as a lining on at least one carrier surface, for example with an appropriate sewing apparatus. The carrier may be derived from existing products or designed and fabricated to custom specifications.

The components may be scaled to larger or smaller dimensions for niche applications. In some embodiments, the fabrics, materials, and manufacturing processes may be for a given environment or for various field conditions (e.g., outdoor, indoor, sterile, etc.).

A method of using the organizing system may include the following steps. The organizing system may be used without divider loops. Alternatively, one or more divider loops may be slid along a length of a strap module to sub-divide the elastic band into a selected number of segments with a selected size and tension. The subdivided strap module may be positioned and oriented, with or without additional strap modules of assorted lengths, on the loop-side fabric of a carrier to form a custom strap arrangement operative to securely organize a given set of items within or on the carrier. Multiple small items, such as pencils and universal serial bus (USB) drives, may be secured within each of the segments. Larger items, such as electronic devices or hand tools, may be held down using one or more strap modules, with slack in the elastic bands eliminated by using a divider loop. The strap module and the loop-side fabric substrate may be used with any commercially available components having hook and/or loop fabric.

Figure 6:
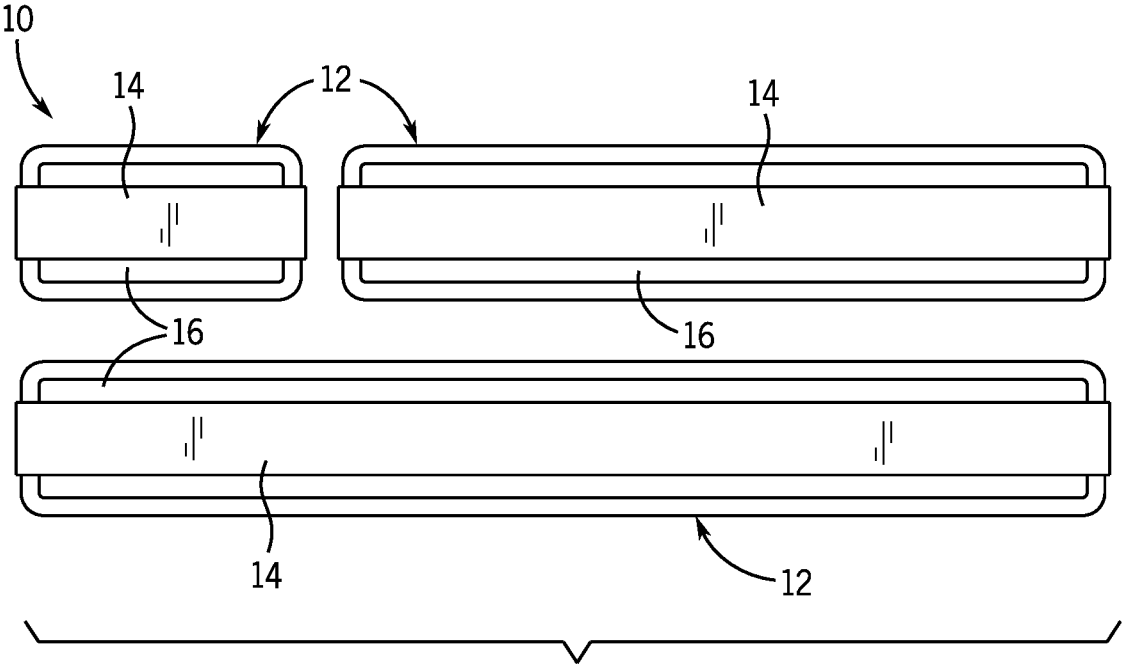
FIG. 6 is a top plan view of a multiple module modular strap system according to an embodiment of the present invention, showing various strap sizes.
Figure 7:
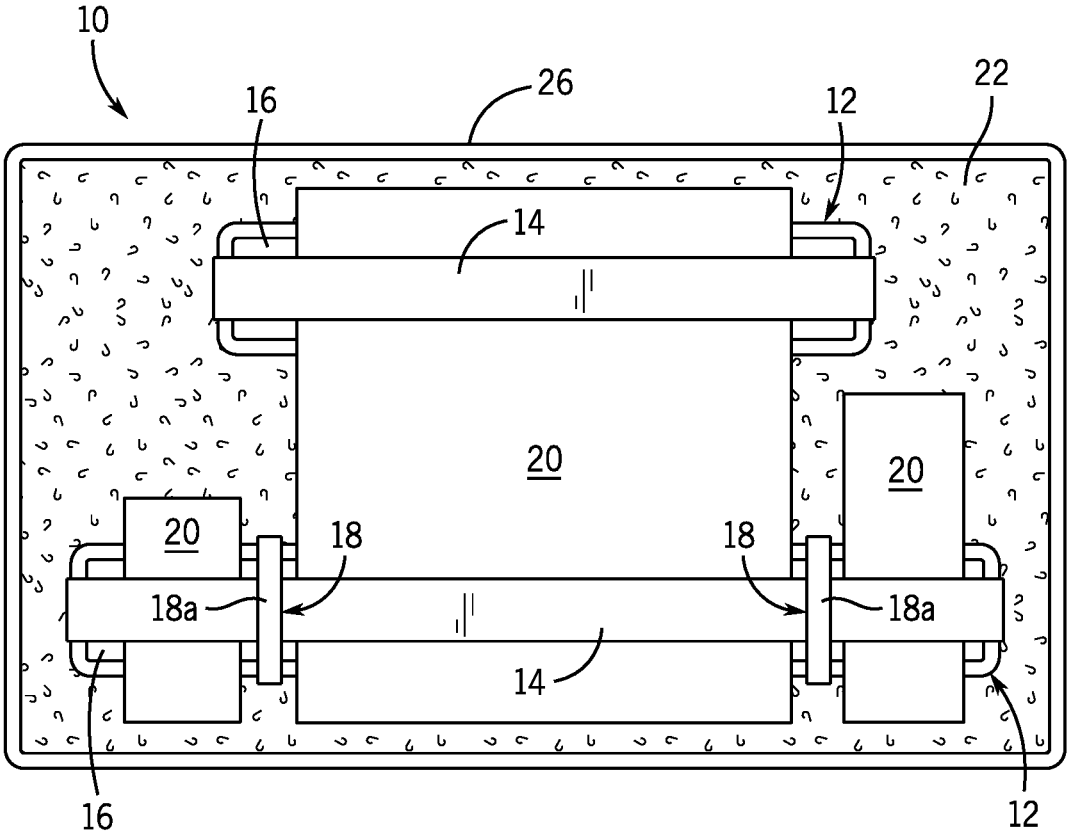
FIG. 7 is a top plan view of a carrier device comprising a modular strap system according to an embodiment of the present invention, shown in use.

Referring to FIGS. 1 through 7, FIGS. 1 to 3 illustrate a modular strap system 10 according to an embodiment of the present invention, with a strap module 12 comprising a band 14 and a loop-side fabric substrate 24 (see FIG. 2) adhered to a stabilizer 16; a divider loop 18 having an arched portion 18*a* and an opening 18*b*; and an item or article 20 secured by the strap module 12. The stabilizer 16 is shown coupled by the loop-side fabric substrate 24 to a hook-side fabric substrate 22. The divider loop 18 is shown in more detail in FIGS. 4 and 5. FIG. 6 illustrates a plurality of strap modules 12 placed in a predetermined pattern. As shown in FIG. 7, the strap modules 12 may be placed on a hook-side fabric substrate 22 lined carrier 26 in a pattern selected to securely accommodate multiple items 20.

It should be understood, of course, that the foregoing relates to exemplary embodiments of the invention and that modifications may be made without departing from the spirit and scope of the invention as set forth in the following claims.

What is claimed is:

1. A modular organizational system comprising:

a) at least one strap module having:

i) a rigid base with a first surface, a second surface opposite the first surface, and four sidewalls enclosing margins of the first surface and the second surface, the second surface having a first touch fastener attached thereto; and ii) an elastic strap extending across the first surface from a first sidewall of the four sidewalls to a second sidewall opposite the first sidewall, said elastic strap being reversibly matable with a second touch fastener; and b) at least one rigid divider loop having four sidewalls forming an aperture configured to slidably accommodate the at least one strap module.

2. The modular organizational system of claim 1, further comprising a carrier device having a third touch fastener attached to at least one carrier surface, said third touch fastener being matable with the first touch fastener.

3. The modular organizational system of claim 1, wherein the four sidewalls of the rigid divider loop form a rounded rectangle with one of the four sidewalls having a concave configuration, extending into the aperture such that the aperture tapers at its center.

4. The modular organizational system of claim 1, wherein the first touch fastener and the second touch fastener are both either a hook portion or a loop portion of a hook-and-loop fastener.

5. A modular organizational carrier device, comprising:

a) at least one strap module having:

i) a rigid base with a first surface, a second surface opposite the first surface, and four sidewalls enclosing margins of the first surface and the second surface, the second surface having a first touch fastener attached thereto; and ii) an elastic strap extending across the first surface from a first sidewall of the four sidewalls to a second sidewall opposite the first sidewall;

b) at least one rigid divider loop having four sidewalls forming a rounded rectangle surrounding an aperture configured to slidably accommodate the at least one strap module, with one of the four sidewalls having a concave configuration, extending into the aperture such that the aperture tapers at its center; and c) a carrier device having a second touch fastener attached to at least one carrier surface, said second touch fastener being matable with the first touch fastener.

6. A method of organizing articles on a carrier, comprising:

a) providing the modular organizational carrier device of claim 5;

b) sliding the at least one rigid divider loop along the at least one strap module, thereby subdividing the elastic strap length to form a first portion of the elastic strap that snugly accommodates an article;

c) pressing the second surface of the rigid base onto the at least one carrier surface such that the first touch fastener mates with the second touch fastener; and d) sliding the article between the first portion of the elastic strap and the rigid base.

7. The method of claim 6, further comprising:

a) providing a second strap module;

b) pressing the second strap module onto the at least one carrier surface adjacent to the at least one strap module; and c) inserting a second article into the second strap module.

8. The method of claim 6, further comprising inserting a second article into a second portion of the elastic strap length, subdivided by the at least one rigid divider loop, and the rigid base.

9. The method of claim 6, further comprising sliding a second rigid divider loop onto the at least one strap module spaced from the at least one rigid divider loop prior to the step of pressing the second surface of the rigid base onto the at least one carrier surface.

* * * * *